United States Patent [19]

Agor

[11] Patent Number: 4,973,018

[45] Date of Patent: Nov. 27, 1990

[54] SUPPORT FOR BATHROOM OBJECTS

[76] Inventor: Alexander Agor, 108-28 Flatlands 7 St., Brooklyn, N.Y. 11236

[21] Appl. No.: 392,563

[22] Filed: Aug. 11, 1989

[51] Int. Cl.[5] ..... A47G 29/00

[52] U.S. Cl. ..... 248/309.1; 211/75

[58] Field of Search ..... 248/512, 519, 534, 535, 248/539, 108, 109, 146, 152, 174, 176, 300, 309.1, 310, 311.2, 314, 315; 211/60.1, 70.6, 75; 206/362.1

[56] References Cited

U.S. PATENT DOCUMENTS

| | | | |
|---|---|---|---|
| 1,915,958 | 6/1933 | Skirrow | 211/75 |
| 2,074,248 | 3/1937 | Barbour | 211/75 |
| 2,200,435 | 5/1940 | Thrasher | 248/314 |
| 2,295,676 | 9/1942 | Meyer | 248/534 |
| 2,427,697 | 9/1947 | Weidler | 248/311.2 |
| 2,773,480 | 12/1956 | Kosher | 248/146 |
| 3,038,612 | 6/1962 | Carey | 211/60.1 |
| 4,213,649 | 7/1980 | Sell | 248/311.2 |

FOREIGN PATENT DOCUMENTS

| | | | |
|---|---|---|---|
| 769802 | 3/1957 | United Kingdom | 248/310 |
| 1543383 | 4/1979 | United Kingdom | 211/70.6 |

*Primary Examiner*—Ramon O. Ramirez
*Assistant Examiner*—Robert A. Olson
*Attorney, Agent, or Firm*—Ilya Zborovsky

[57] ABSTRACT

A support for bathroom objects and the like has a substantially horizontal supporting member with a hole for passing a holder therethrough, and at least one bend extending from one end of the supporting member downwardly therefrom. The supporting member can be provided with a depression for a soap dish, an opening for a glass, openings for toothbrushes, and a central opening between the toothbrush openings for a toothbrush container.

11 Claims, 2 Drawing Sheets

SUPPORT FOR BATHROOM OBJECTS

BACKGROUND OF THE INVENTION

The present invention relates to supports for bathroom objects and the like.

The supports of this general type are known in the art and used in many various designs. They are usually formed as horizontal shelf supported by complicated structures. It is desirable to increase the load-carrying capacity of such supports and provide their simple mounting.

SUMMARY OF THE INVENTION

Accordingly, it is an object of the present invention to provide a support for bathroom objects which has a high strength and is easy and simple to mount.

In keeping with these objects and with others which will become apparent hereinafter, one feature of the present invention resides, briefly stated, in a support which has a substantially horizontal upper member provided with a holding opening for accommodating a part of a holder, and at least one bend at one end of the supporting member. Also, two bends can be provided at both ends of the supporting member.

The supporting member can be provided with a depression for a soap dish, an opening for a glass, a plurality of openings for toothbrushes, and a central opening between the latter for a toothpaste container.

The novel features of the present invention are set forth in particular in the appended claims.

The invention itself however will be best understood from the following description of preferred embodiments, which is accompanied by the following drawings.

DESCRIPTION OF PREFERRED EMBODIMENTS

Figure 1:
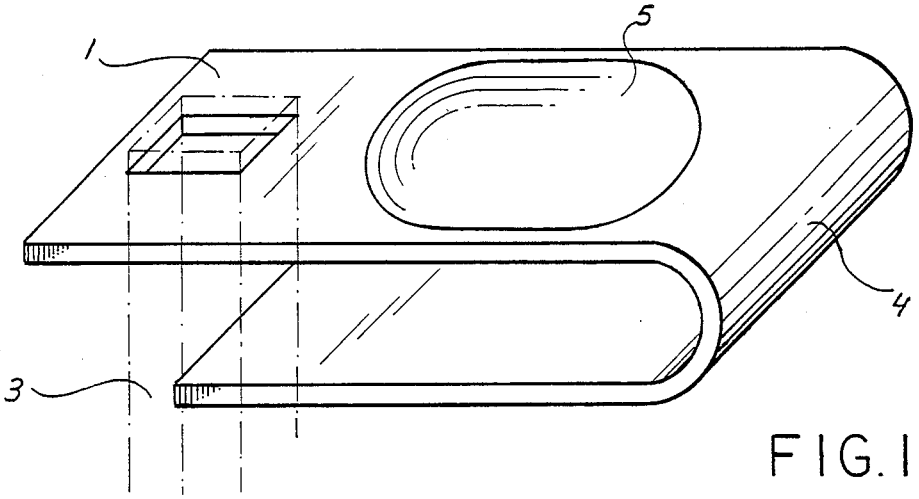
FIG. 1 is a perspective view of a support for bathroom objects and the like in accordance with the present invention

A support for bathroom objects and the like in accordance with the present invention includes a substantially horizontally extending supporting member identified with reference numeral 1. One end of the supporting member 1 has a holding opening 2 which is formed to receive a holder 3. The holder 3 extends with its upper part into the opening 2 and holds the supporting member 1 in a horizontal position. The holder 3 is mounted on a wall by known means which are not shown in the drawings.

The opposite end of the supporting member 1 is provided with a bend extending downwardly from the opposite end and then horizontally and longitudinally toward the first mentioned end in which the opening 2 is provided. The bend 4 is of one piece with the supporting member 1 and together can form a one piece integral element, for example composed of a transparent plastic. The bend 4 imparts a certain rigidity to the opposite end of the supporting member 1 and thereby increases its load carrying capacity.

A depression is formed in a central region of the supporting member 1. The depression serves for accommodating a soap dish, which is at least partially received in the depression.

Figure 2:
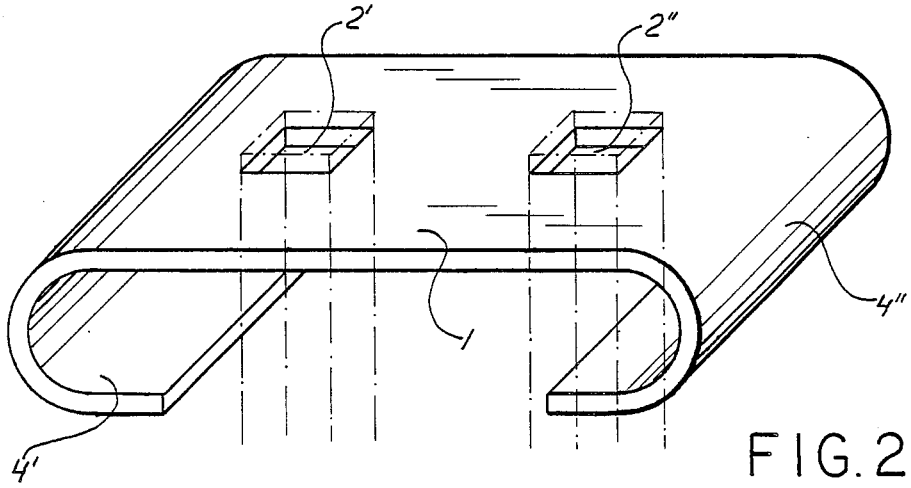
FIG. 2 is a view showing another modification of the support in accordance with the present invention.

In the embodiment shown in FIG. 2 the support has a supporting member 1' which is provided at its both ends with bends 4' and 4''. The supporting member 1' also has two holding openings 2' and 2''. It is supported on two holders. The supporting member serves generally for supporting the objects on its upper surface which can be just plane. Some minor objects can also be placed on the bends.

Figure 3:
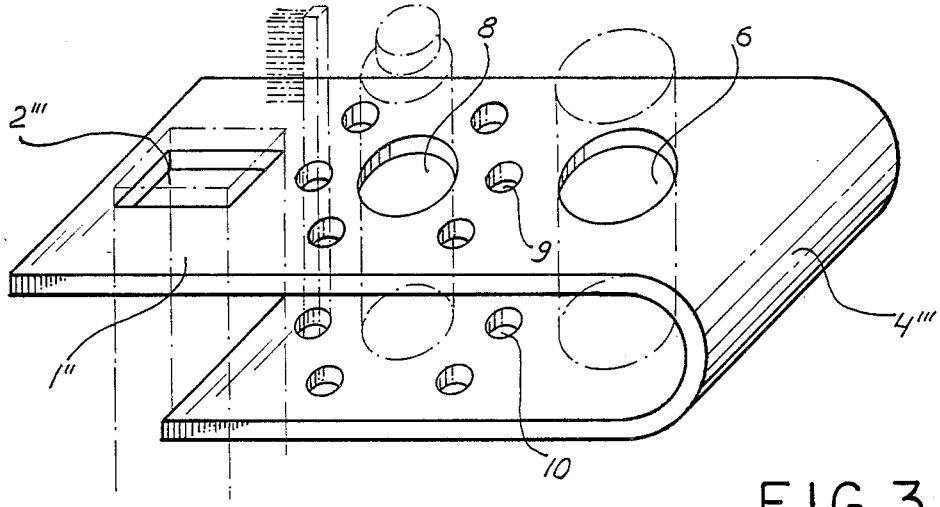
FIG. 3 shows still a further modification of the inventive support.

The embodiment shown in FIG. 3 is designed for supporting the objects connected with toothbrushing. The supporting member 1'' has an opening 6 for receiving a glass with water. It is also provided with a central opening 8 for receiving a toothpaste container. Finally, a plurality of openings g surround the central opening 8 and serve for receiving toothbrushes. A bend 4''' can be provided with further openings 10 for receiving lower portions of the toothbrushes to hold them in a vertical position. The openings g are coaxial with the openings 10. Finally, the opening 2''' serves for receiving a holder.

The supports in FIGS. 2 and 3 are also one piece integral members, formed preferably of transparent plastic.

As can be seen from the drawings, the holder 3 extends vertically with its upper portion in the opening and supports the supporting member. In accordance with another feature of the present invention the left end of the supporting member 1 abuts again the holder and thereby an additional support is provided, preventing bending down of the supporting member.

The invention is not limited to the details shown since various modifications and structural changes are possible without departing from the spirit of the invention. What is desired to be protected by Letters Patent is set in the claims.

I claim:

1. A support for bathroom objects and the like, comprising a substantially horizontally extending supporting member having two opposite ends;

a holding structure provided at least in one of said ends and formed as a hole; a holder extending through said hole and supporting the supporting member; and at least one bend provided at one of said ends and extending downwardly from said one end and then longitudinally in direction toward the other of said ends, said bend having an end abutting against said holder without being connected to said holder.

2. A support as defined in claim 1; and further comprising another bend provided at said other end and extending downwardly from said other end and then substantially longitudinally toward said one end.

3. A support as defined in claim 1, wherein said supporting member has a depression formed in a central region between said ends and shaped for accommodating a soap dish.

4. A support as defined in claim 1, wherein said supporting member has a through opening for passing a glass therethrough so that a glass is supported with its bottom on said bend.

5. A support as defined in claim 4, wherein said supporting member has a plurality of openings for passing toothbrushes therethrough and holding in said support member.

6. A support as defined in claim 5, wherein said bend also has a plurality of openings through which the toothbrushes can pass as well to be also held in said bend.

7. A support as defined in claim 6, wherein said openings of said supporting member are coaxial with said openings of said bend.

8. A support as defined in claim 7, wherein said openings are arranged over a curved contour, said supporting member further having a central opening arranged substantially in a central region between said openings for the toothbrushes and formed so that a toothpaste container can pass through said central opening.

9. A support as defined in claim 1, wherein said supporting member and said bend together form an integral one piece member.

10. A support for bathroom objects and the like, comprising a substantially horizontally extending supporting member having two opposite ends;

a holding structure provided at least in one of said ends and formed as a hole;

at least one bend provided at one of said ends and extending downwardly from said one end and then longitudinally in direction toward the other of said ends;

a holder extending through said hole and supporting said support; and a depression formed in said central region between said ends and shaped for accommodating a soap dish.

11. A support for bathroom objects and the like, comprising a substantially horizontally extending supporting member having two opposite ends;

a holding structure provided at least in one of said ends and formed as a hole;

at least one bend provided at one of said ends and extending downwardly from said one end and then longitudinally in direction toward the other of said ends;

a holder extending through said hole and supporting said support; and a throughopening provided in said supporting member for passing a glass therethrough so that a glass is supported with its bottom on said bend;

a plurality of openings provided in said supporting member for passing toothbrushes therethrough and holding in said support;

a plurality of openings provided in said bend through which the toothbrushes can pass as well to be also held in said bend and coaxial with said openings of said supporting member;

a central opening provided in said supporting members substantially in a central region between said openings for the toothbrushes and formed so that a toothpaste container can pass through the central opening.

* * * * *